US005560105A

United States Patent [19]

Ichiyanagi

[11] Patent Number: 5,560,105

[45] Date of Patent: Oct. 1, 1996

[54] REPLACEABLE BLADE CARTRIDGE FOR RAZOR

[75] Inventor: Masao Ichiyanagi, Seki, Japan

[73] Assignee: Feather Safety Razor Co., Ltd., Osaka-Fu, Japan

[21] Appl. No.: 440,564

[22] Filed: May 12, 1995

[30] Foreign Application Priority Data

May 13, 1994 [JP] Japan ..... 6-100252

[51] Int. Cl.[6] ..... B26B 21/14

[52] U.S. Cl. ..... 30/77; 30/50

[58] Field of Search ..... 30/50, 77, 84, 30/32

[56] References Cited

U.S. PATENT DOCUMENTS 4,914,817 4/1990 Galligan et al. ..... 30/77
5,063,669 11/1991 Althaus ..... 30/77
5,090,124 2/1992 Althaus ..... 30/50
5,410,812 5/1995 Althaus ..... 30/77

FOREIGN PATENT DOCUMENTS 8811356 12/1988 Germany .
9201895 7/1993 Germany .
4-112377 9/1992 Japan .

*Primary Examiner*—Hwei-Siu Payer
*Attorney, Agent, or Firm*—Nawrocki, Rooney & Sivertson, P.A.

[57] ABSTRACT

A blade has an edge exposed between a blade rest and a cap. A guard element extending perpendicularly to a longitudinal direction with respect to the blade contacts with a plurality of points on the edge to define a space between the user's skin and the edge during shaving. The guard element is kept under tension and pressively contacts an upper surface of the edge to apply force acting against the cutting resistance of whiskers to the blade. The guard element has a dent portion under the blade to reduce the distance between the user's skin and the edge.

21 Claims, 4 Drawing Sheets

REPLACEABLE BLADE CARTRIDGE FOR RAZOR

BACKGROUND OF THE INVENTION

1. Field of the Invention

The present invention relates to a replaceable blade cartridge for a razor. More particularly, it pertains to a replaceable, blade cartridge with guard members covering an edge of a blade to protect the user's skin.

2. Description of the Related Art

A careless slip of a razor blade edge by the user during shaving may result in a skin cut. Flabby skin may also lead to skin cuts by the blade edge. To cope with these, various kinds of razors with guard members covering the blade edge have been introduced. A plurality of fine wires or metal film strips have been used as guard members. The fine wires or film strips cover the blade at predetermined intervals in a direction perpendicular to the edge of the blade.

The guard members come into contact with the skin to maintain a slight space between the skin and the blade edge. As a result, the skin is protected from the blade edge regardless of careless slips of the blade by the user. Whiskers come into contact with the blade edge between the guard members to allow smooth shaving.

In the Japanese Unexamined Utility Model Publication No. 4-112377, safety razor provided with a detachable cap pivotally supported on a blade rest is described. The cap is provided with a plurality of fine wires extending perpendicular to the edge of the blade.

This safety razor utilizes very fine piano wires for protecting the user's skin. Accordingly, due to the fine wires, discomfort is reduced.

However, a razor blade performs optimally when the edge is free from cover. By covering the blade edge with the fine wire, the wire diameter establishes a space between the skin and the blade edge. This makes it difficult for the blade edge to come into contact with the whisker at its roots and thus hinders the blade from conducting a clean shave.

Furthermore, a large cutting resistance exists when the whiskers, which have the same hardness as brass wire of the same diameter, are shaved. The cutting resistance delays the advancement of the portions of the razor contacting the whiskers and thus bends the razor blade. This bending hinders cutting. In addition, continued bending leads to permanent deformation of the razor blade. As a result, the deformed blade degrades shaving comfort.

Vibration of the razor blade during shaving is transmitted to the fine wires. This displaces the cutting angle of the razor blade and causes discomfort. In addition, frequent vibration of the razor blade will also damage it.

The Japanese Unexamined Utility Model publication No. 4-112377 discloses a safety razor utilizing very fine piano wires as guard members. It is necessary for all wires to have a certain diameter that assures separation from and protection of the user's skin during a slip of the blade. Therefore, there must be a minimum distance between the razor blade and the skin to protect against cuts. This distance makes a clean shave difficult.

In this razor, a cap is provided, which supports the wires apart from the blades. The fine wires do not vibrate together with the razor blade. However, the cap does not suppress the vibration of the razor blade. Hence, it is difficult to obtain a satisfactorily comfortable shave with this razor.

SUMMARY OF THE INVENTION

It is a major object of the present invention to provide a replaceable blade cartridge with a guard which ensures contact of a blade edge with whiskers at their roots, producing a clean shave.

It is another object of the present invention to provide a replaceable blade cartridge with a guard which resists blade damage.

A further object of the present invention is to provide a replaceable blade cartridge with a guard which allows comfortable shaving.

To achieve the above objects, an improved blade cartridge is disclosed. The cartridge has a blade with an edge exposed between a blade rest and a cap. A guard element extending perpendicularly to a longitudinal direction with respect to the blade contacts a plurality of points of the edge to define a space between the user's skin and edge during shaving. The guard element is kept under tension and pressively contact an upper surface of the edge to apply force acting against the cutting resistance of whiskers to the blade. The guard element has a dent portion under the blade to reduce a distance between the user's skin and the edge.

BRIEF DESCRIPTION OF THE DRAWINGS

The features of the present invention are set forth in the appended claims. The invention, its objects and advantages may best be understood by reference to the following description of the embodiments, together with the accompanying drawings, in which:

DETAILED DESCRIPTION OF PREFERRED EMBODIMENTS

A replaceable blade cartridge C1 according to the first embodiment of the present invention will now be described with reference to FIGS. 1 to 4.

The replaceable blade cartridge Cl includes a blade rest 10 and a cap 30. First and second razor blades B1, B2 are provided on the blade rest 10. Film strip guards 20 are disposed on the blades B1, B2. The cap 30 is fit onto the blade rest 10 to clamp the blades B1, B2 and the guards 20.

Figure 3:
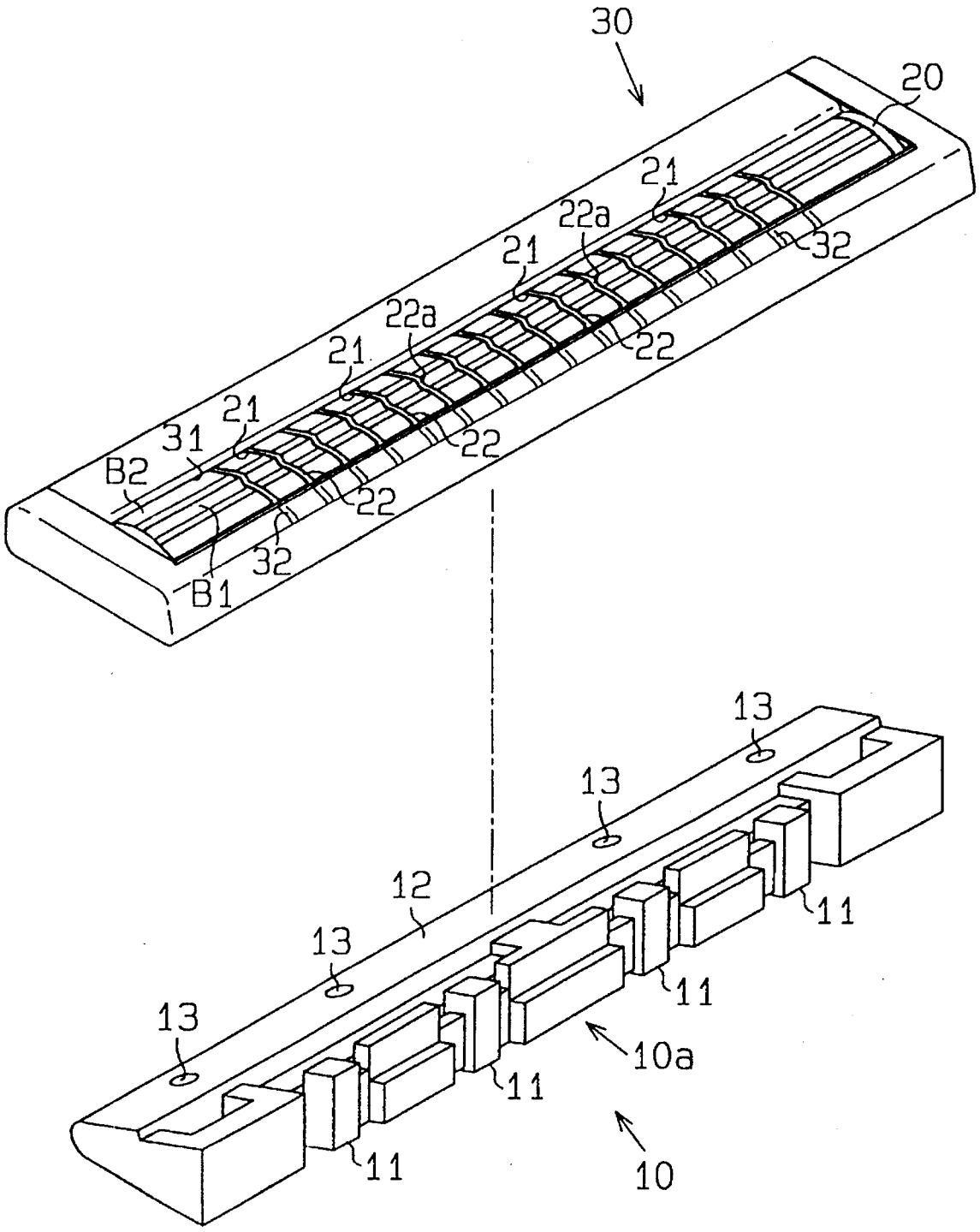
FIG. 3 is an exploded view in perspective of the cartridge.

As shown in FIG. 3, the blade rest 10 is formed in the shape of a rectangle. Various block shaped projections including pressing blocks 11 are formed on the front side 10*a* of the rest 10. A flat surface 12 formed in the middle of the rest 10 extends frontward. Holes 13 provided in the surface 12 receive projections 33 (FIG. 4) of the cap 30.

The rectangular blades B1, B2 have a similar shape to the blade rest 10 and extend sideways. An edge B1*a* of the blade B1 extends further frontward than an edge B2*a* of the blade B2. Holes B1*b*, B2*b* are respectively provided in the middle of each blade B1, B2, respectively, for receiving the projections 33.

A spacer S is interposed between the blades B1, B2. The spacer S includes a flat portion S1 and an engaging portion S2. The engaging portion S2 projects downwardly from the rear end of the flat portion S1. The flat portion S1 has positioning holes S3 in association with the holes B1*b*, B2*b* to allow insertion of the projections 33.

Figure 4:
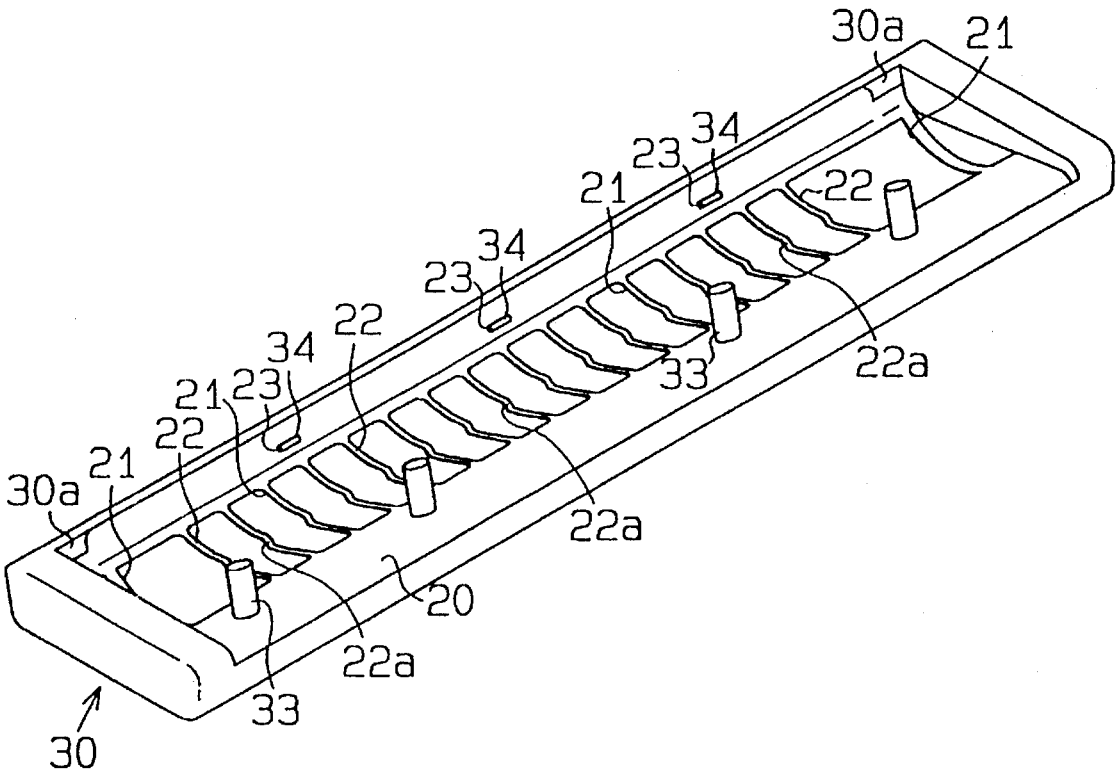
FIG. 4 is a perspective view showing the under side of the cartridge.

A film strip guard 20 made from a stainless plate has a rectangular shape. The guard has a plurality of rectangular holes 21 separated from one another by frontward extending ribs 22. As shown in FIG. 4, the guard includes a plurality of holes 23 in its front portion to receive engaging projections 34 of the cap 30. A plurality of holes 24 are provided in the rear portion for receiving the projections 33.

The ribs 22 separate each blade B1, B2 from the user's skin during shaving. Each rib 22 includes a dent 22*a*, formed by a drawing process, preferably, after the cartridge C1 is mechanically assembled. The dent 22*a* is located in a space between the blades B1, B2. Each rib 22 has a portion, extending from the dent 22*a*, positioned lower than the upper blade B2.

The cap 30 has a rectangular shape in a top plan view. The cap 30 has an opening 31 for exposing the blades B1, B2 and the ribs 22. The cap 30 also includes whisker guides 32 in front of the opening 31 for guiding the whiskers towards the rectangular holes 21.

The cap 30 is attached to the blade rest 10 by fitting the projections 33 (shown in FIG. 4) into the holes 13 of the rest 10. The projections 34, which are formed in the cap's 30 inner wall 30*a*, are fitted into the holes 23 so that the guard 20 is fixed to the cap 30.

The cartridge Cl will next be explained with reference to FIG. 2.

Figure 1:
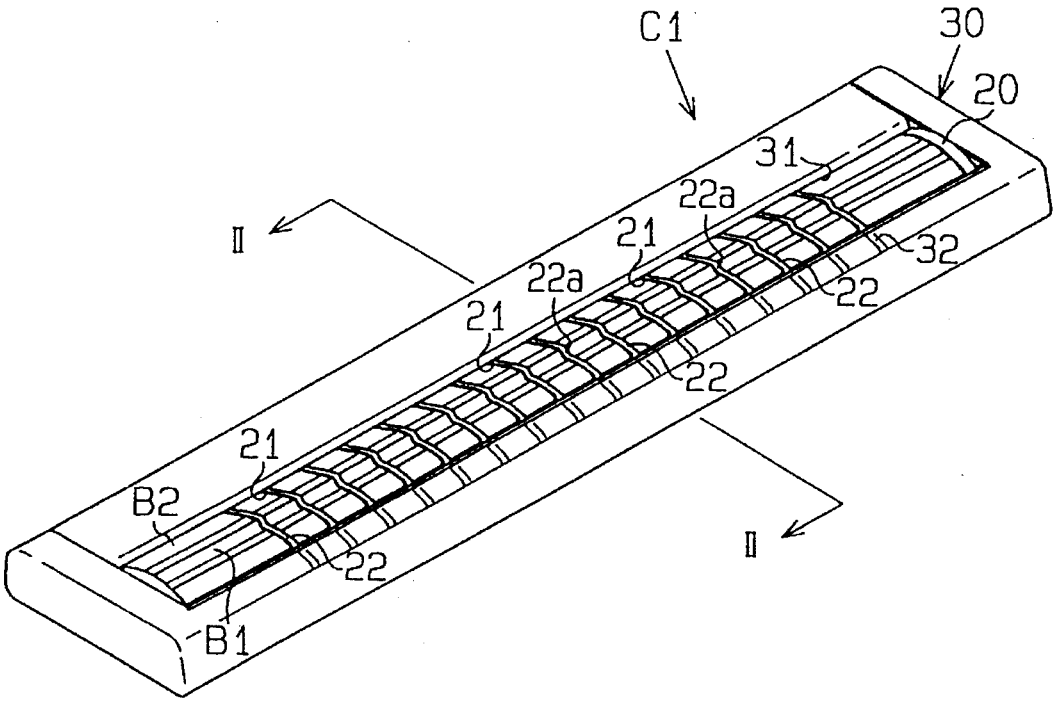
FIG. 1 is a perspective view showing a replaceable blade cartridge according to the first embodiment of the present invention.
Figure 2:
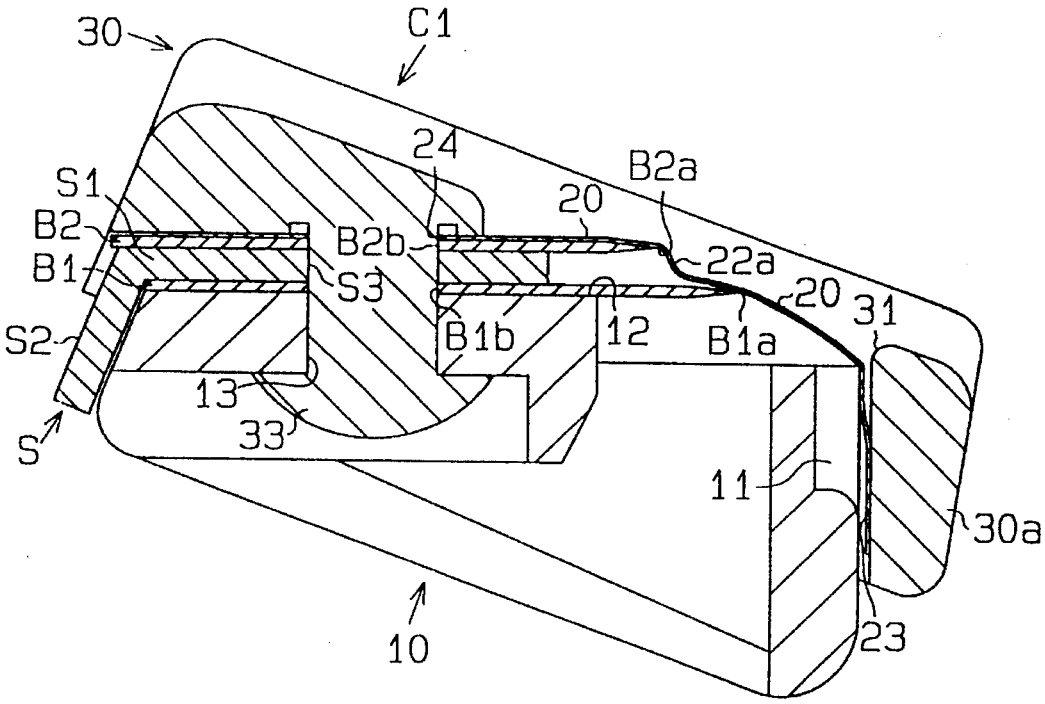
FIG. 2 is a cross-sectional view taken on line II—II in FIG. 1.

FIG. 2 shoes the upper surface of the rest 10 in a horizontal position. The Blade B1 is disposed on the surface 12 so that the blade edge B1*a* sufficiently projects from the front side of the surface 12. The flat portion S1 of the spacer S is placed on the rear portion S2 of the blade B1 with the engaging portion S2 fixed to the rear end of the rest 10. The blade B2 is disposed on the spacer S with its blade edge B2*a* projecting from the spacer S. An area from the blade B2 to the front side 10*a* of the rest 10 is covered by the guard 20.

The pressing blocks 11 of the rest 10 and the inner wall 30*a* of the cap 30 clamp the front portion of the guard 20. The projections 34 engage the holes 23. The blade B2 and the inner surface of the cap 30 clamp the rear portion. The guard 20 is thus secured within the cartridge C1. Each of the ribs 22, thus held under tension, is kept in contact with the blade B2 between the rear of the blade a edge B2*a*. Each rib 22 extends close to the edge B1*a* forward of the dent 22*a*. In this state, each rib 22 applies a downward preload to each edge B1*a*, B2*a*.

The operation of the cartridge C1 according to the first embodiment will now be described.

The cartridge C1 is attached to a holder (not shown) and the blades B1, B2, and the guard 20 are slid on the user's skin through the opening 31 of the cap 30. The whiskers, guided into the rectangular holes 21 of the guard 20 by way of the guides 32, are cut by the blade B1.

Each whisker, having the same hardness as a brass wire with. the same diameter, causes a large cutting resistance. Accordingly, a large cutting force is required. Therefore, the blade B1 is subject to bending forces by the cutting resistance of the whiskers.

The cutting resistance acting on the edge B1*a* is transmitted to each rib 22 and tends to displace the guard 20. However, the tension acting on the guard 20 counters the cutting resistance. Accordingly, each rib 22 remains stationary.

The ribs 22, anchored at their originally assembled position despite the cutting resistance, apply pressure on and hold the blade B1 against displacement regardless of the cutting resistance. Accordingly, the deformation of the blade B1 is substantially prevented.

Cutting resistance is increased by an incomplete cut of the whisker by the blade B1. The remaining whisker comes into contact with the second blade B2. The dent 22*a* allows the whisker to readily contact the edge B2*a* and be cut off at the root despite the intervening guard 20.

As with the blade B1, cutting resistance is applied to the blade edge B2*a* during cutting with the blade B2. This results in the application of bending forces on the blade B2. The forces are then transmitted to each rib 23. However, the guard 20, under tension counteracts the bending forces and, as a result, each rib 22 remains in its originally assembled position. The edge B2*a*, which each rib 22 applies pressure to, is held steady against the cutting resistance forces and thus resists bending.

The ribs 22 are kept in contact with the surface of the blade B2 between its rear end and the edge B2*a* so as to support the blade B2 more securely than the blade B1. This helps the blade B2 resist bending. The pressure applied to each blade edge B1*a*, B2*a* withstands the cutting resistance forces of the whiskers and prevents the blade edges B1*a*, B2*a* from vibrating. Accordingly, deformormation of the blades B1, B2 caused by vibration is avoided.

Furthermore, the dent 22*a* located between the blades B1 and B2 enables the blade B2 to readily contact the roots of the whiskers, regardless of the existing film guard 20, and enables complete cutting.

Figure 5:
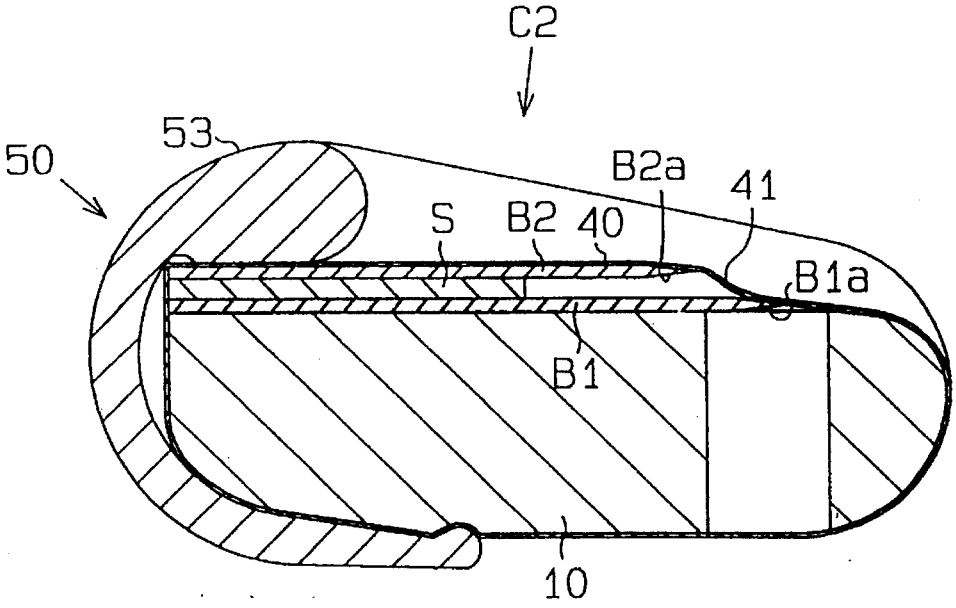
FIG. 5 is a perspective view showing a replaceable blade cartridge according to the second embodiment of the present invention.
Figure 6:
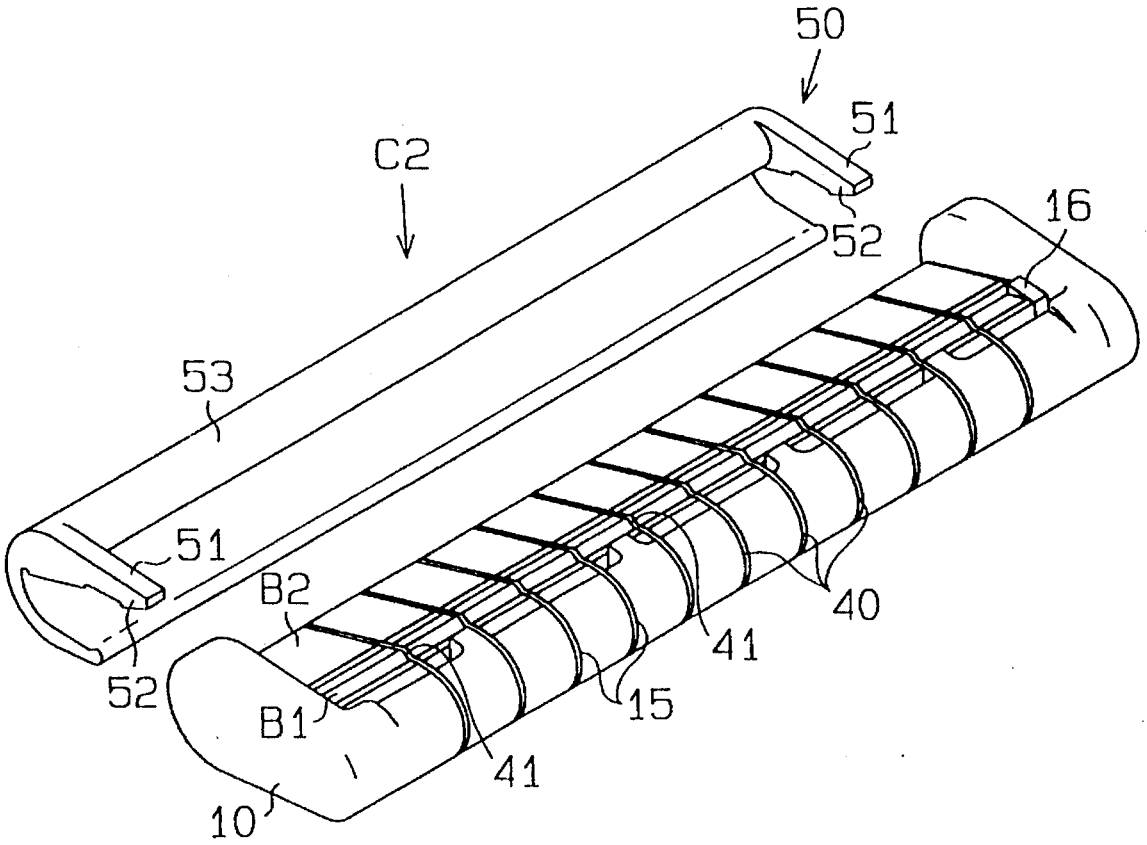
FIG. 6 is an exploded view in perspective of the cartridge.

A replaceable blade cartridge C2 according to the second embodiment will now be described referring to FIG. 5 and FIG. 6. Equivalent or substantially equivalent members employed in the first embodiment will be denoted with the same numeral in these drawings. Accordingly, only differing parts will be described in detail.

The cartridge C2 in this embodiment employs a wire guard 40 in lieu of the film guard. The guard 40 winds around blades B1, B2 and a blade rest 10. Therefore, the guard 40 surrounds the rest 10, each blade B1, B2, and a spacer s.

Grooves 15 are formed on the rest 10 to guide the guard 40 into each designated winding position. A first end of the guard 40, made of a stainless wire, is fixed to a first hook (not shown) formed on the rest 10. The guard 40, guided by the grooves 15, is then wound around the rest 10 and the Outer surfaces of the blades B1, B2. The guard is spirally wound at the rear side of the rest 10. Each winding of the guard 40 is positioned perpendicular to the edge of the blades B1, B2 with equal spacing between each winding at the surface of the cartridge C2. The second end of the guard 40 is fixed to a second fastening portion (not shown) after a designated number of windings. A dent 41 is provided on the guard 40 between the two blades B1, B2.

A cap 50 has a U-shaped configuration with an opening between the ends. An engaging piece 51 is formed at the upper section of the U-shaped portion at each end of the cap 50. A projection 52 formed under each piece 51 engages a block 16 of the rest 10. A blade cover 53 is provided at the upper side of the cap 50 between the two engaging pieces 51.

In this cartridge C2, the rest 10, a spacer S, and each blade B1, B2 are integrally held by the guard 40. The cap 50 is attached to the rest 10 by fitting it from the rear side, and then clamping the block 16 with the projection 52.

The cutting resistance of whiskers contacting the blade edges B1*a*, B2*a* acts as a force tending to displace the guard 40. However, the guard 40 is in a state of tension. Furthermore, the dent 41 formed on the guard 40 at the position between the two blades B1, B2 applies pressure to act against the cutting resistance. Accordingly, the blades B1, B2, especially the blade B2, do not bend and are able to readily cut whiskers regardless of the cutting resistance. This provides the user with a very comfortable shave. Furthermore, the dent 41 enables the edges B1*a*, B2*a* to easily come into contact with the whiskers. This allows a clean shave regardless of the guard 40.

Additionally, the blades B1, B2 are not bent and do not vibrate during shaving. That is, forces acting to deform the blades B1, B2 are countered. This prevents the blades B1, B2 from being damaged.

The guard 40 according to this embodiment employs a single wire. Thus, manufacturing of the guard is simplified.

Although embodiments according to the present invention have been described in detail, it should be understood that various changes, substitutions and alterations can be made herein without departing from the spirit and scope of the invention as defined by the claims as set forth herein.

For example, a guard according to the present invention can be employed on a cartridge having a single blade.

Furthermore, in the above embodiments, the guards 20, 40 are made from stainless steel. However, materials having a high corrosion resistance such as titanium and aluminum may also be utilized. A synthetic resin which can simply undergo a heated drawing process may also be used.

What is claimed is:

1. A replaceable blade cartridge for a razor comprising:

a blade rest;

a cap mounted on the blade rest;

a first blade disposed between the blade rest and the cap, said first blade including a first edge exposed between the blade rest and the cap;

a second blade disposed above the first blade and extending in parallel with the first blade between the blade rest and the cap, said second blade including a second edge exposed between the cap and the blade rest;

a guard element disposed to contact a plurality of points on the second edge to define a space between a user's skin and the second edge, wherein said guard element is kept under tension to press against an upper surface of the second edge, and wherein said guard element has a dent portion positioned beneath the second edge.

2. The blade cartridge as set forth in claim 1, wherein said guard element is made of a film with a high corrosion resistance, said film having a plurality of ribs extending perpendicularly to a longitudinal direction with respect to the blade.

3. The blade cartridge as set forth in claim 2, wherein said film is made of a thin stainless plate.

4. The blade cartridge as set forth in claim 3, wherein said film has a rear portion clamped by the cap and the blade and a front portion clamped by the cap and the blade rest, whereby the film is kept under tension.

5. The blade cartridge as set forth in claim 1, wherein said guard element is made of at least one wire with a high corrosion resistance.

6. The blade cartridge as set forth in claim 5, wherein said wire is made of stainless.

7. The blade cartridge as set forth in claim 6, wherein said blade rest and said blades are assembled to one another, and wherein said wire is wound on the blade rest and the blades to inseparably hold the blade rest and the blades.

8. The blade cartridge as set forth in claim 7, wherein said blade rest has in its front surface a plurality of grooves, each of the grooves extending perpendicularly to a longitudinal direction with respect to the blades, for guiding the wire wound on the blade rest.

9. A replaceable blade cartridge for a razor comprising:

a blade rest;

a cap mounted on the blade rest;

a blade disposed between the blade rest and the cap, said blade including a cutting edge exposed between the cap and the blade rest;

a guard element disposed to contact a plurality of points on the edge to define a space between a user's skin and the edge, wherein said guard element is kept under tension to press against an upper surface of the edge, and wherein said guard element has a dent portion positioned under the second edge.

10. The blade cartridge as set forth in claim 9, wherein said guard element is made of a film with a high corrosion resistance, said film having a plurality of ribs extending perpendicularly to a longitudinal direction with respect to the blade.

11. The blade cartridge as set forth in claim 10, wherein said film is made of a thin stainless plate.

12. The blade cartridge as set forth in claim 11, wherein said film has a rear portion clamped by the cap and the blade and a front portion clamped by the cap and the blade rest, whereby the film is kept under tension.

13. The blade cartridge as set forth in claim 9, wherein said guard element is made of at least one wire with a high corrosion resistance.

14. The blade cartridge as set forth in claim 13, wherein said wire is made of stainless.

15. The blade cartridge as set forth in claim 14, wherein said blade rest has in its front surface a plurality of grooves, each of the grooves extending perpendicularly to a longitudinal direction with respect to the blade, for guiding the wire wound on the blade rest.

16. The blade cartridge as set forth in claim 13, wherein said blade rest and said blade are assembled to one another, and wherein said wire is wound on the blade rest and the blade to inseparably hold the blade rest and the blade.

17. The blade cartridge as set forth in claim 9 further comprising a lower blade disposed below the blade and extending in parallel with the blade and a spacer interposed between the blades.

18. A replaceable blade cartridge for a razor comprising:

a blade rest;

a cap mounted on the blade rest;

a pair of parallel blades located between the blade rest and the cap, the pair having a first blade and a second blade, each blade having an exposed sharp cutting edge;

a set of tensioned, elongated, guard elements, wherein each element contacts the blade edges and is oriented such that it is substantially perpendicular to the edges, and wherein at least one of said guard elements is dented such that it curves inwardly at a location between the blades.

19. The cartridge according to claim 18, wherein the guard elements are made of stainless steel.

20. The cartridge according to claim 18, wherein a plurality of the guard elements are dented like said at least one guard element.

21. The cartridge according to claim 18, wherein the guard elements are made of wire.

* * * * *

UNITED STATES PATENT AND TRADEMARK OFFICE

CERTIFICATE OF CORRECTION

PATENT NO. : 5,560,105

DATED : October 1, 1996

INVENTOR(S) : Masao ICHIYANAGI

It is certified that error appears in the above-identified patent and that said Letters Patent is hereby corrected as shown below:

Col. 5, line 50, after "the" and before "blade", insert --second--.

Col. 5, line 54, after "the" and before "blade", insert --second--.

Signed and Sealed this

Eleventh Day of February, 1997

*Attest:*

*Attesting Officer*

BRUCE LEHMAN

*Commissioner of Patents and Trademarks*